US005450648A

United States Patent [19]

Dovin et al.

[11] Patent Number: 5,450,648

[45] Date of Patent: Sep. 19, 1995

[54] MASON'S HAND TROWEL

[76] Inventors: Joseph P. Dovin; Joseph W. Dovin, both of 324 Main St., Forest City, Pa. 18421

[21] Appl. No.: 155,838

[22] Filed: Nov. 23, 1993

[51] Int. Cl.[6] ..... B05C 17/10

[52] U.S. Cl. ..... 15/235.4; 15/235.8; 425/458

[58] Field of Search ..... 15/235.4, 235.8; 425/458

[56] References Cited

U.S. PATENT DOCUMENTS 2,301,498 11/1942 Ames ..... 15/235.8
4,080,684 3/1978 Venditti ..... 15/235.8 X
5,231,729 8/1993 Rose ..... 15/235.8 X

*Primary Examiner*—Chris K. Moore
*Attorney, Agent, or Firm*—Douglas M. Clarkson

[57] ABSTRACT

The mason's hand trowel has a blade member with a handle supported from the back surface of the blade by attachment members so that the handle is spaced a desired distance from the back of the blade. At least one, but preferably two surfaces are supported by a plate so that they are movable contiguously relative to a working edge of the blade member and an adjacent edge. At least one guide pin extends through an opening in the handle and is attached to the plate with its movable surfaces, and a spring extends from the under side of the handle to the plate to maintain the surfaces in a normally retracted position.

9 Claims, 1 Drawing Sheet

MASON'S HAND TROWEL

BACKGROUND OF THE INVENTION

1. Field of the Invention

The present invention, generally, relates to hand tools and, more particularly, to a new and improved masons hand trowel.

Tools used by both professional builders and those that are characterized as do-it-yourselfers include trowels for handling and working with grout, cement, plaster and similar plastic and pliable material. Usually, there are two types of manual maneuvers involved when working with such materials, one concerns picking up a quantity of the material and depositing it in a desired location, and the second concerns a smoothing or other manipulating the deposited quantity in some planned manner.

A professional individual working in this area would most probably have little use for a masons hand trowel as provided by the invention, because of experience in manually manipulating a trowel, but a do-it-yourselfer, having limited experience, will find a trowel according to the invention not only helpful but a significant time and mess saver, which will become more evident as the description proceeds.

2. Description of the Prior Art

The prior art is replete with many forms of trowels to both apply and to smooth mortar of all types. For example, U.S. Pat. No. 4,669,970 to Perry describes a more recent tool arranged for finishing edges and corners.

U.S. Pat. No. 4,884,312 to Clark describes a hand trowel having a specially formed handle.

U.S. Pat. No. 3,346,905 to Scarpelli describes a trowel with edges configured with removable teeth portions.

A review of the construction of prior trowels described by each of the above identified United States patents reveals that there is still a need for a masons hand trowel with a structure permitting easier use by a non-professional mason, such as today's do-it-yourselfer.

OBJECTS AND SUMMARY OF THE INVENTION

A principal object of the present invention is to provide a masons hand trowel of such construction as to admit a successful scooping action by an inexperienced handyman type of individual.

It is also an important object of the present invention to provide a masons hand trowel of such construction as to permit an easy scooping action and that will provide assistance in retaining the scooped material on the trowel.

Briefly, a masons hand trowel that is constructed and arranged according to the principles of the invention has the usual blade with a handle for manipulating manually. There is at least one surface arranged perpendicular to a working edge of the blade surface which is moveable from the handle perpendicularly in a contiguous position relative to the working edge. Having this one surface moved to an extended position provides a means that assists in retaining mortar material being scooped.

These and other objects, features and advantages of the invention will become more readily apparent from the following detailed description of the presently preferred embodiment when taken in conjunction with the accompanying drawings.

DETAILED DESCRIPTION OF THE INVENTION

Figure 1:
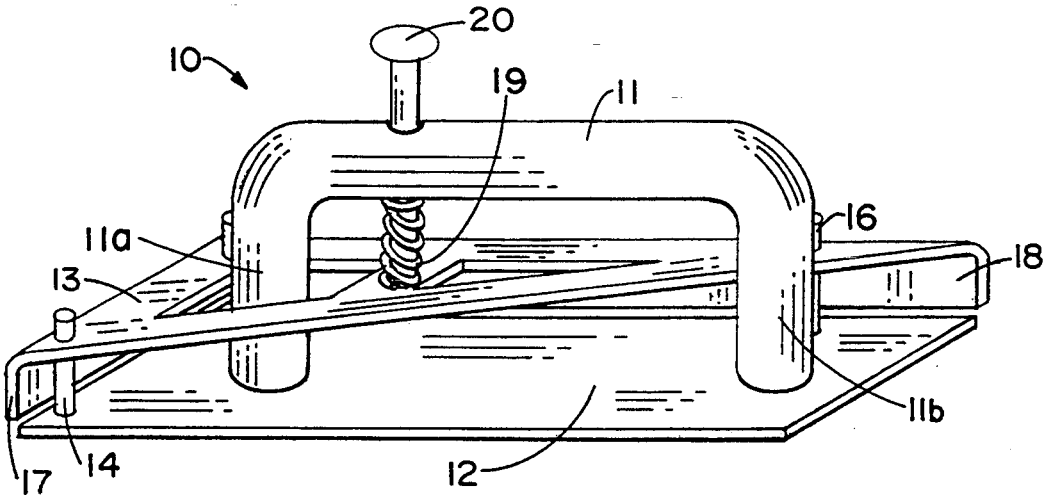
FIG. 1 is a view in perspective to illustrate important features of construction for the masons hand trowel of the present invention.

Referring first to FIG. 1 of the drawings, the masons hand trowel that is constructed according to the invention is identified generally by the reference numeral 10 and includes a handle 11 affixed to a blade 12 to permit the blade 12 to be readily manipulated manually.

Note particularly that the handle 11, that is, the part of the masons hand trowel 10 that is grasped by the hand, is spaced a distance from a back surface of the blade 12 by two handle attachment supports 11*a* and 11*b*. The length of these supports 11*a* and 11*b* is sufficient to permit fingers on a user's hand to grasp the handle 11 without interfering with a rigid plate 13 above the blade 12 and beneath the handle 11.

Figure 2:
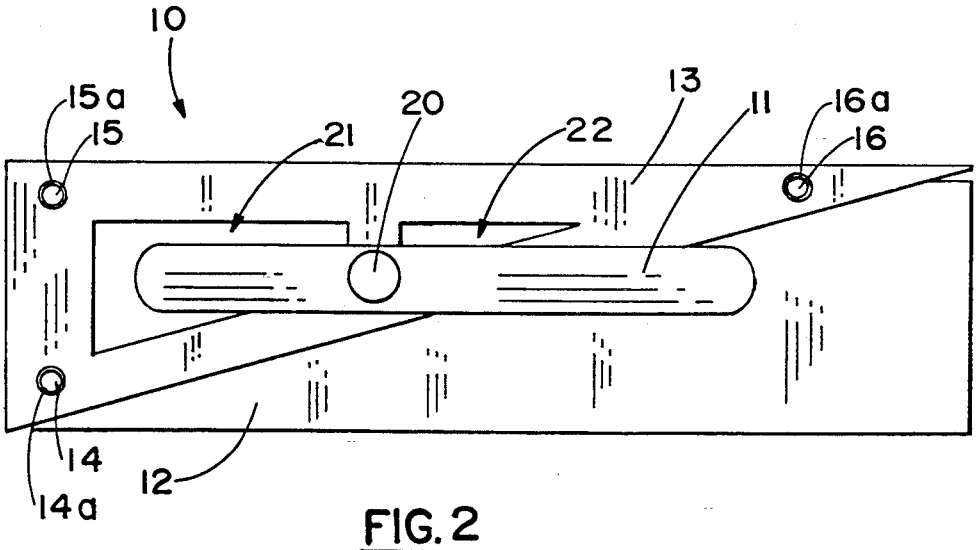
FIG. 2 is a top view of the masons hand trowel of the invention.

For the presently preferred arrangement of the masons hand trowel 10 there are three guide pins 14, 15 and 16 that extend upwardly from the blade 12 in the general direction toward the handle 11, each fitting within its own guide opening in the plate 13. These guide openings are illustrated by the reference numerals 14*a*, 15*a* and 16*a* in FIG. 2 of the drawings.

It is important for proper use of the masons hand trowel 10 that each of the pins 14, 15 and 16 slide readily and easily within its own opening without binding, as will be appreciated more fully as the use of the masons hand trowel is described in further detail. Also, each of the guide pins 14, 15 and 16 is fixedly attached to and supported by the back surface of the blade 12.

The openings 14*a*, 15*a* and 16*a* each are formed in the rigid plate 13, as described supra, so that the plate 13 can be moved while being guided by the pins 14, 15 and 16. The distance that the plate 13 is moved is small, and the purpose will be described in detail hereinafter.

Attached to the rigid plate 13 are two surfaces 17 and 18 that extend in a direction generally perpendicular to the surface of the plate 13. These surfaces are illustrated and seen clearly in FIG. 1 of the drawings.

The two surfaces 17 and 18 are configured generally to be the same length as the edges of the blade 12 next to which they are supported to move. The width, i.e., the vertical height as viewed in FIG. 1 of the drawings, can be any convenient dimension determined by the manufacturer, varying usually from ⅜ inch to 2.0 inches.

The plate 13 is moved in a direction toward the back surface of the blade 12 against the action of a spring 19 by depressing a button 20 on a plate support pin 20*a* that extends through the handle 11 and is fixedly attached to the rigid plate 13. Note particularly that the spring 19 is attached to the handle 11 at one end and to the rigid plate 13 at the opposite end, so that it is effective to support and to retain the plate 13, along with the surfaces 17 and 18, in a retracted position, as illustrated in FIG. 1 of the drawings.

Accordingly, it is illustrated that the rigid plate 13 is moveable vertically, as viewed in FIG. 1, by depressing the button 20 which moves the plate support pin 20*a* extending the spring 19 until the plate 13 touches the blade 12. In such movement, the plate 13 is maintained in its position relative to the blade 12 by the guide pins 14, 15 and 16.

Also in this movement, the surfaces 17 and 18 do not necessarily scrape against the edges of the blade 12, but rather, they move past these edges contiguous to them. The button 20 is located in a position on the handle 11 where it is accessible most conveniently for contact by the thumb or the index finger of a user.

The configuration of the rigid plate 13 is triangular, as illustrated in the drawings, but its primary purpose is to be a functional support for the movable surfaces 17 and 18 in a controlled manner. In the form illustrated, the plate 13 is provided with two openings 21 and 22.

The opening 21 permits the plate 13 to move without touching the handle support 11*a*. The opening 22 serves the purpose of uniformity in decoration and weight reduction for the plate 13. Of course, it will be understood that both of the openings will function significantly as weight reduction features for the masons hand trowel 10 of the present invention.

A professional individual in this art would have little difficulty in scooping mortar and retaining it on the front surface of a flat blade. They do it so smoothly, in fact, that it appears easy.

However, one who is not engaged in this activity regularly, such as today's homeowner, working as an amateur or as a do-it-yourselfer, usually produces more mortar on his shoes than on the wall or the surface on which he is working. It is not as simple as it appears, and it can be quite discouraging because the purpose that a homeowner engages in this effort is to save money.

With the masons hand trowel of the invention, the button 20 is depressed first, which moves the surfaces 17 and 18 to extend below the blade 12, as viewed in FIG. 1. Now, with the surfaces 17 and 18 extended, the masons hand trowel 10 is ready for scooping mortar on its mortar support, or front, surface, which is the under side of the blade 12 from that to which the handle 11 is attached.

With the masons hand trowel 10 supporting mortar, it will appear in a position reversed from that illustrated in FIG. 1. The handle 11 will appear beneath the blade 12 with the hand of the user holding it tightly and transporting the mortar to the wall or surface on which it is to be applied.

During this interval, the button 20 is kept depressed to keep the surfaces 17 and 18 extended, so as to assist in retaining the mortar on the mortar supporting, or front, surface of the masons hand trowel 10. Then, as a part of the act of applying the mortar to a wall, the button 20 is released as the masons hand trowel 10 is turned.

The invention has been shown, described in substantial detail with reference to a presently preferred embodiment. It will be understood by those skilled in this art that changes and modifications may be made, but all such changes and modifications are within the true spirit and scope of the invention which is defined by the appended claims.

What is claimed is:

1. A mason's hand trowel for supporting and transporting mortar material and for applying the mortar material to a surface, comprising:

a plate-like blade having a working edge, a front surface and a back surface, said front surface being substantially flat for supporting a predetermined mortar material and having said working edge along one side;

a handle attached to said back surface of said plate-like blade, including an attachment to support said handle in a predetermined position relative to said back surface of said plate-like blade;

a first surface supported movably by said handle substantially perpendicular to said working edge of said plate-like blade; and means extending from said handle for moving said first surface supported movably by said handle relative to said working edge;

whereby said first surface is moved relative to said working edge of said plate-like blade from a retracted position to an extended position for supporting mortar on said front surface of said plate-like blade.

2. A mason's hand trowel as defined by claim 1 including a second surface attached to said first surface supported movably by said handle and arranged perpendicular to said plate-like blade at an angle to said working edge of said plate-like blade to provide additional support for mortar carried on said front surface.

3. A mason's hand trowel as defined by claim 2 including a substantially flat plate supported from said handle including at least one opening for said attachment, a guide pin attached movably to said substantially flat plate and passing slidably through an aperture in said handle with a button on its uppermost end for depressing by a user to move said substantially flat plate closer to said back surface of said plate-like blade, a spring positioned between said handle and said substantially flat plate about said guide pin for urging said substantially flat plate to a predetermined position relative to said plate-like blade, and said first and second surfaces attached to said substantially flat plate to move contiguously past adjacent predetermined edges, including said working edge, of said plate-like blade for supporting said mortar material on said front surface.

4. A mason's hand trowel as defined by claim 1 wherein said attachment to support said handle on said back surface of said plate-like blade includes two spaced apart supports.

5. A mason's hand trowel as defined by claim 1 wherein said first surface is attached to a substantially flat plate configured as a triangle.

6. A mason's hand trowel as defined by claim 3 wherein said substantially flat plate configured as a triangle defines three corners with an opening adjacent each corner, and said back surface of said plate-like blade having guide pins extending through each opening.

7. A mason's hand trowel as defined by claim 3 wherein said substantially flat plate configured as a triangle has at least one opening, and said handle attachment affixed to said back surface through said opening in said substantially flat plate.

8. A mason's hand trowel as defined by claim 5 wherein said substantially flat plate configured as a triangle with said first surface attached perpendicular to said plate-like blade to clear said working edge of said plate-like blade, and a pin movably extending from said handle for moving said substantially flat plate and said first surface relative to said plate-like blade.

9. A mason's hand trowel as defined by claim 1 wherein said second surface is attached to and supported in a position at a right angle with said first surface.

* * * * *